United States Patent [19]

Urquhart et al.

[11] Patent Number: 4,725,997

[45] Date of Patent: Feb. 16, 1988

[54] CONTINGENT DOSING DEVICE

[75] Inventors: John Urquhart, Palo Alto, Calif.; Harold R. Elgie, Fairfield, Iowa

[73] Assignee: Aprex Corporation, Palo Alto, Calif.

[21] Appl. No.: 899,412

[22] Filed: Aug. 22, 1986

[51] Int. Cl.[4] ..... G04B 47/00; A47B 67/02

[52] U.S. Cl. ..... 368/10; 368/109; 221/2; 221/15

[58] Field of Search ..... 368/10, 28–30, 368/72, 73, 74, 107–113, 250, 251; 221/2, 3, 9, 15; 340/309.1, 309.15; 364/569

[56] References Cited

U.S. PATENT DOCUMENTS

| | | | |
|---|---|---|---|
| 3,369,697 | 2/1968 | Glucksman et al. | 221/9 |
| 3,395,829 | 8/1968 | Cogdell et al. | 221/15 |
| 3,651,984 | 3/1972 | Redenbach | 221/3 |
| 3,722,739 | 3/1973 | Blumberg | 221/3 |
| 3,762,601 | 10/1973 | McLaughlin | 221/2 |
| 3,815,780 | 6/1974 | Bauer | 221/15 |
| 3,911,856 | 10/1975 | Ewing | 116/121 |
| 3,917,045 | 11/1975 | Williams et al. | 194/4 |
| 3,968,900 | 7/1976 | Stambuk | 221/3 |
| 3,998,356 | 12/1976 | Christensen | 221/2 |
| 4,034,757 | 7/1977 | Glover | 128/260 |
| 4,207,992 | 6/1980 | Brown | 221/15 |
| 4,223,801 | 9/1980 | Carlson | 221/3 |
| 4,258,354 | 3/1981 | Carmon et al. | 340/309.4 |
| 4,275,384 | 6/1981 | Hicks et al. | 340/309.4 |
| 4,360,125 | 11/1982 | Martindale et al. | 221/2 |
| 4,361,408 | 11/1982 | Wirtschafter | 368/10 |
| 4,367,955 | 1/1983 | Ballew | 368/10 |
| 4,382,688 | 5/1983 | Machamer | 368/10 |
| 4,419,016 | 12/1983 | Zoltan | 368/10 |
| 4,448,541 | 5/1984 | Wirtschafter | 368/10 |
| 4,473,884 | 9/1984 | Behl | 364/479 |
| 4,483,626 | 11/1984 | Noble | 368/10 |
| 4,490,711 | 12/1984 | Johnston | 340/309.4 |
| 4,504,153 | 3/1985 | Schollmeyer et al. | 368/10 |
| 4,526,474 | 7/1985 | Simon | 368/10 |

*Primary Examiner*—Vit W. Miska

*Attorney, Agent, or Firm*—Ciotti & Murashige, Irell & Manella

[57] ABSTRACT

A contingent dosing device which actively controls the pattern in which doses of one or more pharmaceutical preparations are administered to a patient. The device is programmed with information concerning an initial dosing regimen, and monitors deviations from that regimen. Based on the acceptability of the calculated deviations, the device may dispense or withhold medication. The invention also includes an automatic drug dosage compliance method using the contingent dosing device.

30 Claims, 13 Drawing Figures

CONTINGENT DOSING DEVICE

BACKGROUND OF THE INVENTION

1. Field of the Invention

This invention relates to the dispensing of pharmaceutical preparations. More particularly, the invention relates to a device for actively controlling the pattern in which doses of one or more pharmaceutical preparations are administered to a patient.

2. Description of Background Art

When a physician prescribes medication in a nonhospital setting or when an over-the-counter medication is sold, substantial reliance is placed on the patient to comply with the dosing instructions. Unfortunately, even in the case of acute illness, patient compliance with the prescribed dosing regimen is often casual or negligent. This problem, as it is exhibited even among maximally motivated patients suffering from a disease as serious as glaucoma with associated loss of sight, has recently been discussed by M.A. Kass and associates in two papers appearing in Volume 101 of the AMERICAN JOURNAL OF OPHTHAMOLOGY at pages 515 and 524. These papers pointed out that a substantial fraction of the patients took less than one half their required doses of sight-saving medication, that virtually all of the patients reported that they took all of their doses and that the prescribing physicians were completely unable to accurately identify those patients who were not taking their medication. This failure to properly self-medicate can lead to inaccurate feedback to persons monitoring the patient's progress and misinformation regarding the effectiveness of the drug. Similarly, the dosing regimen initially set is often inflexible and not designed to be easily modified to correspond to changes in the patient's condition.

A number of devices have been proposed heretofore as aids to reliable self-medication. These include:

passive medication containers that segregate medicines according to the times they should be taken (for example, the dispensing packages in which birth control pills are marketed);

medication dispensers that provide clock-actuated alarms (see, for example, U.S. Pat. No. 3,651,984 to Redenbach);

medication dispensers from which the patient can receive medication only within certain time intervals (see, for example: U.S. Pat. Nos. 3,722,739 to Blumberg; 3,762,601 to McLaughlin; and 3,815,780 to Bauer);

medication dispensers designed for general use in therapeutics, lacking specifications peculiar to particular pharmaceuticals (see, for example, U.S. Pat. No. 3,911,856 to Ewing); and medication dispensers that record the times at which the patient removes medication (see, for example: U.S. Pat. Nos. 4,034,757 to Glover; 4,360,125 to Martindale et al.: 4,419,016 to Zoltan; and 4,504,153 to Schollmeyer et al.).

Other references relating to this general subject include the following: U.S. Pat. Nos. 3,369,697 to Glucksman et al.; 3,395,829 to Cogdell et al.; 3,917,045 to Williams; 3,968,900 to Stambuk; 3,998,356 to Christensen; 4,207,992 to Brown; 4,223,801 to Carlson; 4,258,354 to Carmon et al.; 4,275,384 to Hicks et al.; 4,361,408 to Wirtschafter; 4,367,955 to Ballew; 4,382,688 to Machamer; 4,448,541 to Wirtschafter; 4,473,884 to Behl; 4,483,626 to Noble; 4,490,711 to Johnston; and 4,526,474 to Simon.

These prior art devices are sometimes helpful aids for improving the reliability of self-medication. However, implicit in these devices is the assumption that dosage regimen and patient condition are unchanging. In the reality of everyday therapeutics, however, both the prescription of drugs and the self-administration of drugs are subject to many contingencies, including, but not limited to:

changes in the course or nature of the patient's disease;

changes in the overall reliability with which the patient takes a given medication;

particular circumstances that may arise which will prevent the patient from faithfully following the prescribed regimen (e.g., having no access to water, being preoccupied by other business, having previously exhausted the medication supply, or being in a social situation where self-administration of drugs would be embarrassing);

changes in the patient's physiological mechanisms of drug absorption, metabolism or excretion that necessitate changes in the dosing regimen; and occurrences of acute nausea or vomiting that preclude the oral self-administration of a particular medication.

SUMMARY OF THE INVENTION

Accordingly, it is an object of the present invention to provide a drug-dispensing device which facilitates the accurate self-administration of drugs.

It is another object of the present invention to provide a contingent dosing device that can accommodate foreseeable contingencies which may arise during the medication-taking period.

It is still another object of the present invention to provide a contingent dosing device which includes an initial programmed dosing regimen, records deviations from that regimen, and instructs the patient as to whether a dose is proper at a given time.

It is yet another object of the present invention to provide a contingent dosing device as above, in which the initial dosing regimen is later modifiable either automatically or by the patient.

It is a further object of the present invention to provide an automatic drug dosage compliance method.

It is still a further object of the present invention to provide an automatic drug dosage compliance method, which method includes providing an automated dispensing device programmed with a dosing regimen, automatically computing a patient's deviation from the regimen, and informing the patient whether a medication dose is proper at a particular time.

It is a general object of this invention to provide a device that can overcome the shortcomings of the prior art discussed above.

Additional objects, advantages and novel features of the invention will be set forth in part in the description which follows, and in part will become apparent to those skilled in the art on examination of the following, or may be learned by practice of the invention.

In one aspect of the present invention, a device is provided which is capable of controlling in an interactive or contingent sense the dispensing of a sequence of pharmaceutical doses to a patient.

In another aspect this invention provides a device to correct at least partially the errors and deviations from the pharmacokinetic and pharmacodynamic ideal as encountered in self-medication in which device information regarding the ideal regimen is stored, deviations from this ideal are detected and pharmacokinetically and pharmacodynamically appropriate regimen modifications based on the deviations are selected and communicated to the patient.

The device includes a time counter capable of recording one or more starting times and of measuring at least one elapsed time period from the one or more starting times. The device also includes an electronic memory in which can be recorded an initial dispensing regimen (including information concerning the times for taking doses and information regarding acceptable deviations from the programmed times). The device is provided with a means for recording the times that the patient requests a dose of the drug and a means for determining therefrom the actual deviation from the prescribed regimen. The device compares the actual deviation with the preprogrammed, acceptable deviation and informs the patient whether the originally programmed dose may be taken, i.e., if the actual deviation is less than or equal to the acceptable deviation, the device will indicate to the patient that the originally programmed dose may be taken but if the actual deviation is greater than the acceptable deviation, the device will indicate that the originally programmed dose should not be taken or should be modified in some manner.

This device, with its preselected deviation "windows", does not impose upon the patient an overly fussy precision in dosing but rather maintains and adjusts where needed a schedule of self-medication so as to maintain levels or concentrations of drugs within the body within pharmacodynamically recognized upper and lower limits.

It is understood by those engaged in the science of pharmacodynamics that there is a certain imprecision in the definition of the upper and lower limits of drug levels or concentrations within the body. It is also known that there is a degree of imprecision in the defined relation between dosing and the ensuing time course of drug levels or concentrations within the body. Regimen adjustments made against these somewhat imprecise criteria may, in general, be made in three ways:

(1) by adjusting the time intervals between doses, (2) by adjusting the size of a dose given at one or more designated times, and (3) by a combination of adjusting time intervals and adjusting the size of the dose. However, this third method is potentially very complicated and confusing to the patient—time can be varied continuously but dose size generally can only be modified stepwise since drugs are most commonly formulated in unit dosage forms such as 100 mg or 250 mg tablets or the like. The present invention provides a device which can carry out such complex changes in regimen and facilitate the dosing in accord with the new regimen with a minimum of confusion.

In certain embodiments of this invention, the device can additionally include a gate or valve or the like for controlling the dispensing of the dose. when so configured, the device can carry out its informing of the patient function by either dispensing a dose of the drug, refusing to dispense a dose, or altering the dose of the drug which it dispenses.

If desired, the dispensing regimen may be modified in response to contingencies beyond deviations in the patient's drug requests such as changes in the patient's condition. In such cases the embodiment of the device includes means for inputting information regarding these additional contingencies.

In certain other embodiments the device of this invention can additionally include means for recording when drug doses are requested and/or dispensed. This permits healthcare professionals upon reviewing this record to identify self-medication noncompliance and thus to correctly correlate the course of the patient's condition with the true dosing of the drug.

In an additional aspect of the invention, an automatic drug dosage compliance method is provided. The method entails providing a contingent dosing device as above, which device has a patient-portable memory unit, entering into the memory unit an initial dosing regimen capable of later modification, and controlling, based on either the initial or the modified dosing regimen, the dispensing of medication to a patient.

BRIEF DESCRIPTION OF THE DRAWINGS

In this specification and appended claims, reference will be made to the accompanying drawings in which

DETAILED DESCRIPTION OF THE INVENTION

Figure 1:
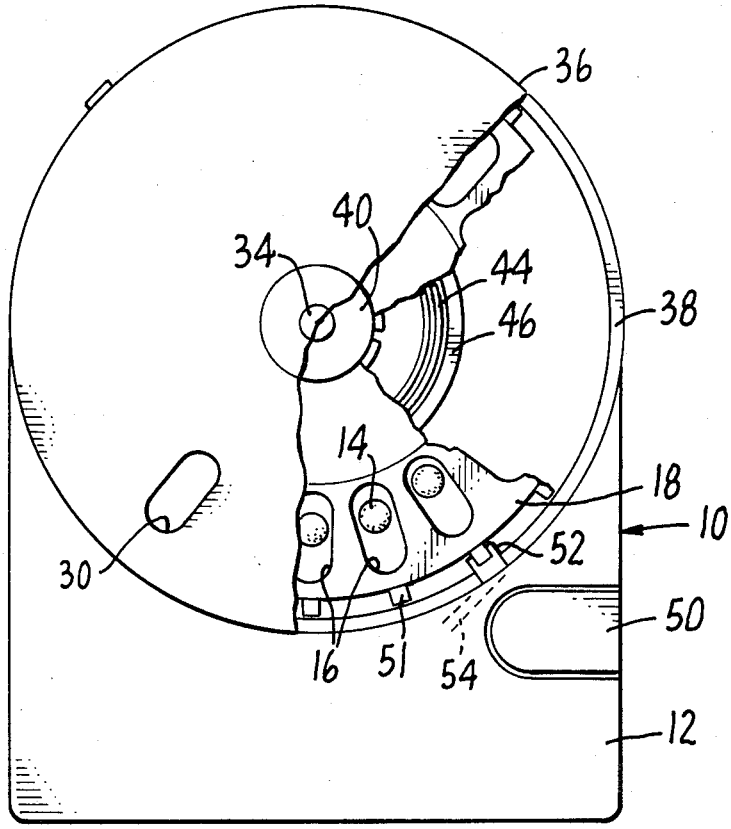
FIG. 1 is a partially cross sectional, top plan view of a contingent dosing device according to an embodiment of the invention.
Figure 2:
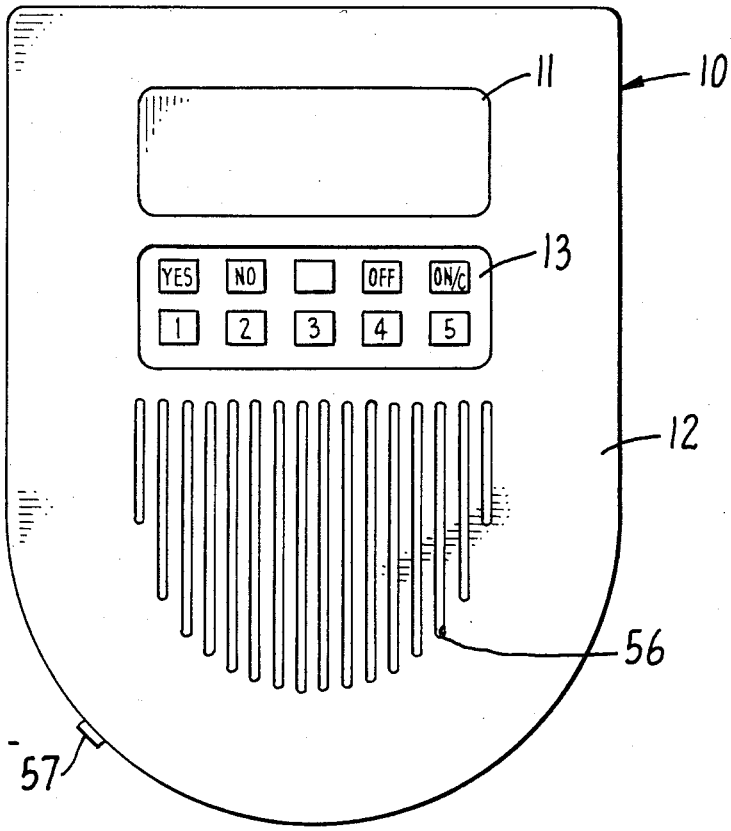
FIG. 2 is a bottom plan view of a contigent dosing device shown in FIG. 1.
Figure 3:
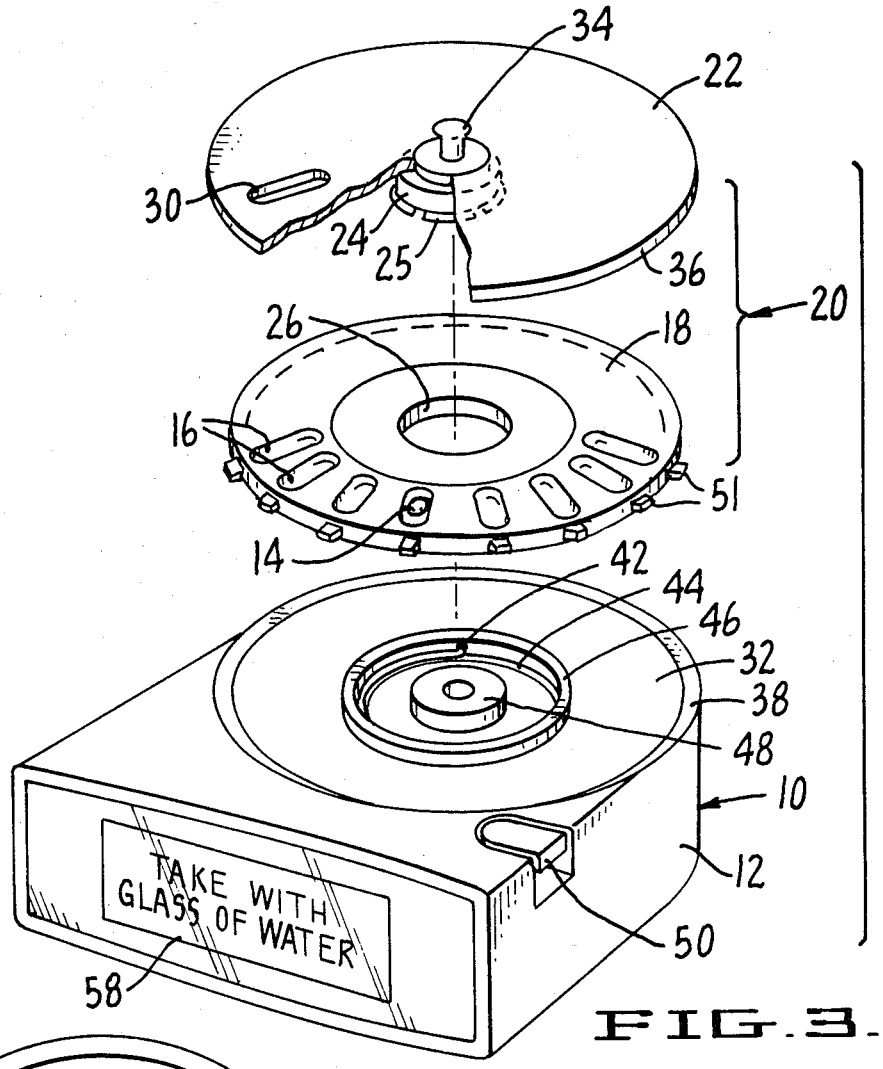
FIG. 3 is a perspective view of a contingent dosing device shown in FIG. 1.

FIGS. 1 through 5 illustrate one possible embodiment of the contingent dosing device. The device is shown generally at 10, and includes housing 12 in which both the medication and the electronic circuitry of the invention are contained. In the embodiment shown, the housing 12 carries a battery access cover 11 and a key pad 13 which carries a number of pushbutton switches which can serve as on-off switches and also was a port for the patient to input information into the device, if called for. Housing 12 also is shown carrying a data access port 57 through which programming information can be fed into the control circuit of the device or through which data stored within the device can be accessed by healthcare professionals.

Unit doses of medication 14 such as tablets or capsules are provided within dose apertures 16 located within and disposed around the circumference of rotatable circular base 18 of carousel assembly 20. Carousel assembly 20 also includes rotatable lid 22 coaxially aligned with and affixed to circular base 18 at a central flange 24 by means of retaining collars 25 on central flange 24 protruding through central aperture 26 of base 18 and rotatably gripping the inner lower edge of aperture 26. Flange 24 is sized to extend downward into the housing 12 of device 10 and has an inner diameter which will frictionally engage a center post 48 in housing 12 when carousel assembly 20 is in place on the device. Lid 22 is provided with dispensing port 30 which is adapted to align with apertures 16. The lower surface of lid 22 and apertures 16 are essentially in contact so as to define a series of closed compartments. As base 18 is independently rotatable relative to lid 22, dispensing port 30 may be aligned with any one of compartments 16 upon rotation of base 18 relative to the lid 22. Thus, access to individual dosing compartments and the pharmaceuticals they contained may be gained through port 30.

Carousel assembly 20 is a separate integral unit or cartridge which is adapted to fit within recess 32 of housing 12. These carousels can be separately filled or refilled and marketed as called for by the marketplace. The carousel is a friction press fit onto center post 48 and may be removed therefrom by lifting up on knob 34. When carousel assembly 20 is fitted within recess 32, perimeter 36 of lid 22 rests on peripheral wall 38 of housing 12.

Figure 4:
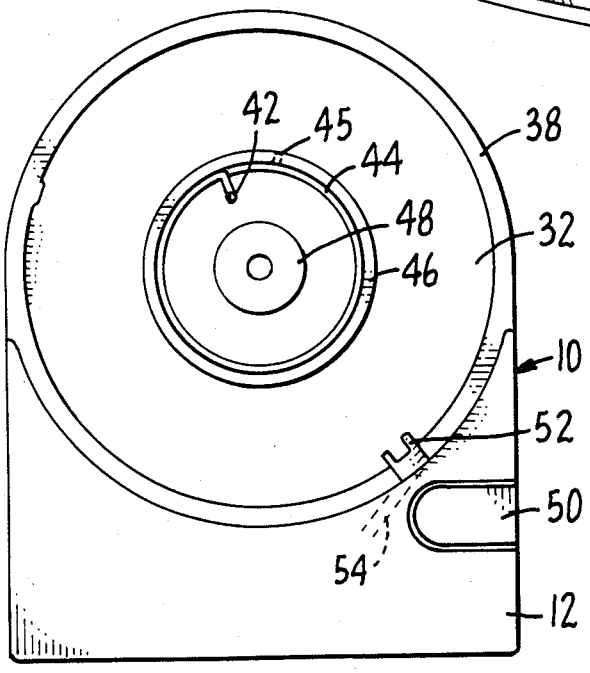
FIG. 4 is a top plan view of the device shown in FIG. 1 with the carousel assembly removed.
Figure 5:
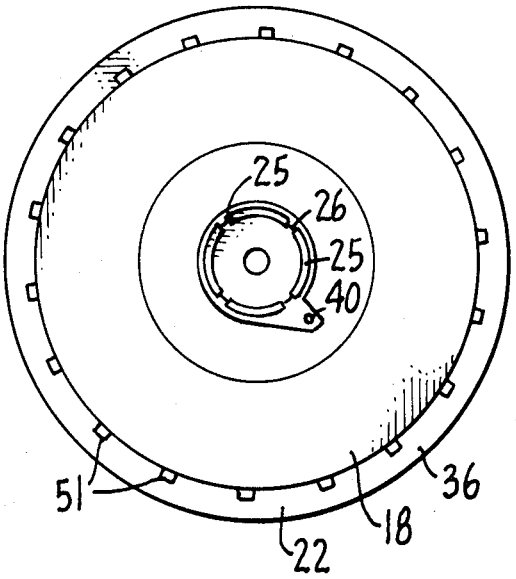
FIG. 5 is a bottom plan view of the carousel assembly of the device shown in FIG. 1.

As is most clearly shown in FIGS. 5 and 4, the underneath surface of rotatable base 18 near the flange surrounding aperture 26 carries an outwardly extending wedge 40. When the carousel assembly 20 is fitted within recess 32, wedge 40 is adapted to engage inwardly protruding end 42 of spring 44 coiled within circular enclosure 46 in recess 32 in housing 12. The other outer end 45 of coil spring 44 is attached to fixed housing 12. When the coiling of coil spring 44 is tightened, energy is stored which can apply a force against wedge 40 and thereby supply a driving force to cause carousel base 18 to rotate about center post 48 relative to housing 12 and lid 22.

Carousel base 18 is provided with a plurality of spaced apart ribs 51 disposed around the edge of the base's perimeter. Typically, the number and spacing of these ribs 51 corresponds to the number and spacing of the apertures 16 in the base 18. Each of these ribs is designed to co-operatively engage latch 52. When latch 52 engages a rib, it prevents rotation of the base 18 as driven by spring 44. Latch 52 is connected to lever 54. When lever 54 is depressed, it causes latch 52 to release its engagement with rib 51 and permits the base to rotate until the next rib 51 comes in contact with the latch. Thus, a single dose storage aperture is permitted access to port 30. Lever 54 can also serve as a sensor designed to signal to the device when a patient is requesting a medication dose (i.e., requesting access to one or more compartments 16 through dispensing port 30). This can be done by having lever 54 change a switch when the patient requests a dose by pressing it. Lever 54 and latch 52 can also be equipped with a stop (not shown) which can block the full movement of the lever and the subsequent release of the latch unless or until the device has determined that the requested dose is proper to dispense. In this case, the lever 54 sends the request signal to the device as previously described. In addition to signalling the request of a dose via the lever 54, the movement of the latch and movement of the rotatable base can also be used to drive a switch to signal that a dose has in fact been dispensed.

The device's response to the patient request again varies with the particular embodiment of the invention. As just noted, one response can be to allow latch 52 to disengage and permit base 18 to rotate and administer a dose of drug. Another response can be to not permit base 18 to rotate and thus to withhold the requested dose. The decision as to which action to take can be carried out as will be described hereinafter with reference to FIGS. 6–11. The response can also be a patient-detectable message such as an audio signal i.e an internally generated audio signal (heard through grating 56), a visual signal (message informing patient appearing on display screen 58) or a combination thereof.

Figure 6:
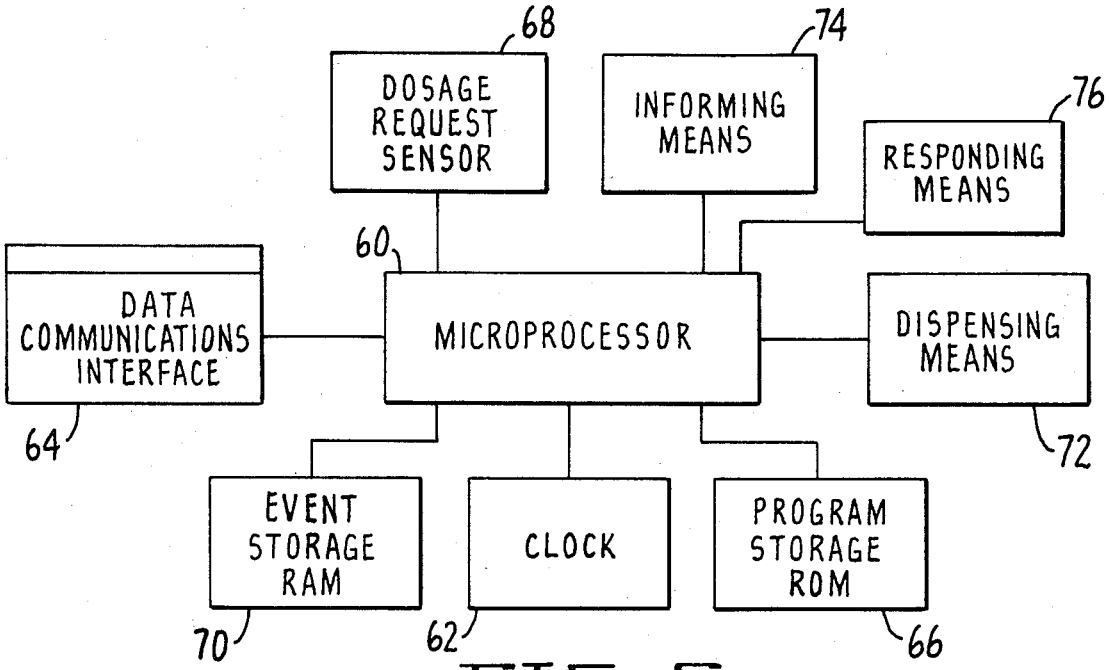
FIG. 6 is a functional block diagram of the circuitry within the contingent dosing device according to embodiments of the invention.

FIG. 6 is a functional block diagram of the control circuitry of the device. In FIG. 6 a microprocessor unit 60 is provided which is the central logic unit of the device. A clock, or time counter 62, is also provided which is capable of recording one or more regimen starting times and of measuring elapsed time periods therefrom. Information concerning an initial dosage regimen is entered by a pharmacist or physician through the data communications interface 64 and stored in the PROM 66. (An initial dosage regimen might be, e.g., four 50-mg doses at once, followed by one dose every three hours.) The initial dosage regimen includes information relating to acceptable deviations from the programmed dosage times. When a patient requests a dose as outlined above, the dosage request sensor 68 is activated, and the fact and time of the request may, if desired, be stored in the event storage RAM 70. Based on the foregoing information, the microprocessor will calculate the actual deviation of the time of the patient's request from the acceptable deviation as initially recorded. If the actual deviation is less than or equal to the acceptable deviation, a dose will be dispensed but, if the actual deviation is greater than the acceptable deviation, a dose will be withheld. If the dose is dispensed, a dispensing means 72 will activate, e.g. in the embodiment described in FIGS. 1–5 above, base 18 would automatically rotate so as to align dispensing port 30 with a dosing compartment 16, thereby allowing the patient access to the drug.

Whether or not the actual deviation exceeds the acceptable deviation, the device can inform the patient as to the results of the comparison. An informing means 74 such as an audio or visual signal (or combination thereof), or a time lock, will instruct the patient as to whether a dose may be taken at the time requested. For example, the device may be provided with either an alpha-numeric display or an electronically synthesized voice, or both, to permit communication with the patient. In addition, the device may include a responding means 76 such as a buzzer or the like to alert the patient when a dose is due to be taken.

In an alternative embodiment of the device, the informing means further includes: (1) a means for instructing the patient, e.g. with instructions regarding special conditions for taking the delivered medication, with instructions to to the patient to contact the patient's health care professional or to convey diagnostic information to that professional; and (2) a means for interrogating the patient as to the patient's condition. For example, if the initially prescribed regimen requires one dose every four hours, with an acceptable deviation, or window, of one-half hour on either side of the dose time, and a patient requests a dose two hours early, the device will interrogate the patient as to the reason for the early request such as through the informing means 74. The patient then responds through the data communications interface 64, and if, for example, the dose has been requested early because of pain or a worsening of the patient's disease state, the device may take additional action such as to alert the patient to contact the patient's health care professional. If the patient has requested an early dose accidentally, the patient may so inform the device through the data communications interface 64 and wait for the recorded dose time. If a patient has requested a dose two hours late, the device may inquire, for example, if a pill was dropped or lost, or if undesirable side effects warranted putting off of the medication, etc. Again, the patient may respond through the data communications interface, either by suitable electrical switches and/or by electronic speech recognition, and the device may either modify the regimen accordingly (e.g., in the case of an accidental late dose, modifying the entire regimen so as to shift all doses by two hours) or instruct the patient to contact his health care professional (e.g., in the case of severe side effects) with, optionally, diagnostic information ascertained by the device.

The informing means may be tailored to the amount of detail desired or needed by the patient, which may depend on the patient's understanding of the nature of his or her disease, on the nature and rationale of the various medications prescribed therefor, and on changes in the patient's familiarity with the content and style of the instructions. The informing means may also be designed so as to avoid consistently identical phrasing or otherwise repetitive instructions.

The instructing means may be in the form of an audio or visual message to the patient to call his or her health care professional. Alternatively, the instructing means may be such that the device can contact the health care professional directly, such as by means of a cordless phone.

The device is additionally provided with a means for modifying the initial regimen, either automatically or by the patient, physician or pharmacist. For example, if a patient has requested a dose late, i.e. outside the acceptable deviation from the recorded dosing time, the device may be programmed to shift the entire dosing regimen by the actual time deviation. Alternatively, the patient or pharmacist may reprogram the device to accommodate changes in the regimen. This capability of modifying the initial dosage regimen entails receipt by the device and its contained logic unit of encoded radio signals, directing a change in regimen. To this end, the dispenser includes a means for receiving and decoding radio signals that have been especially coded to maintain confidentiality and avoid mistaken activation due to receipt of unrelated radio signals.

The device is also capable of operating as above based on the modified regimen. That is, the modified regimen will include information based on acceptable deviations from the dosing times as modified, so that dispensing of medication will be controlled by the device as above for the initial dosing regimen.

The device may also allow for the type and strength of drug loaded into the dispenser, which information could be included as part of the initial recorded dosing regimen. If a patient were to request an additional dose of a drug, or an early dose, the device would thus take into account any difficulties that might arise as a result of a higher dose.

The time counter in the device of the present invention may, if desired, record the times at which a patient received each dose throughout a dosing regimen. Thus, a dosing record is created which is useful for later examination of patient compliance. Such a compliance monitoring system is clearly useful to confirm drug efficacy and the like.

Figure 7A:
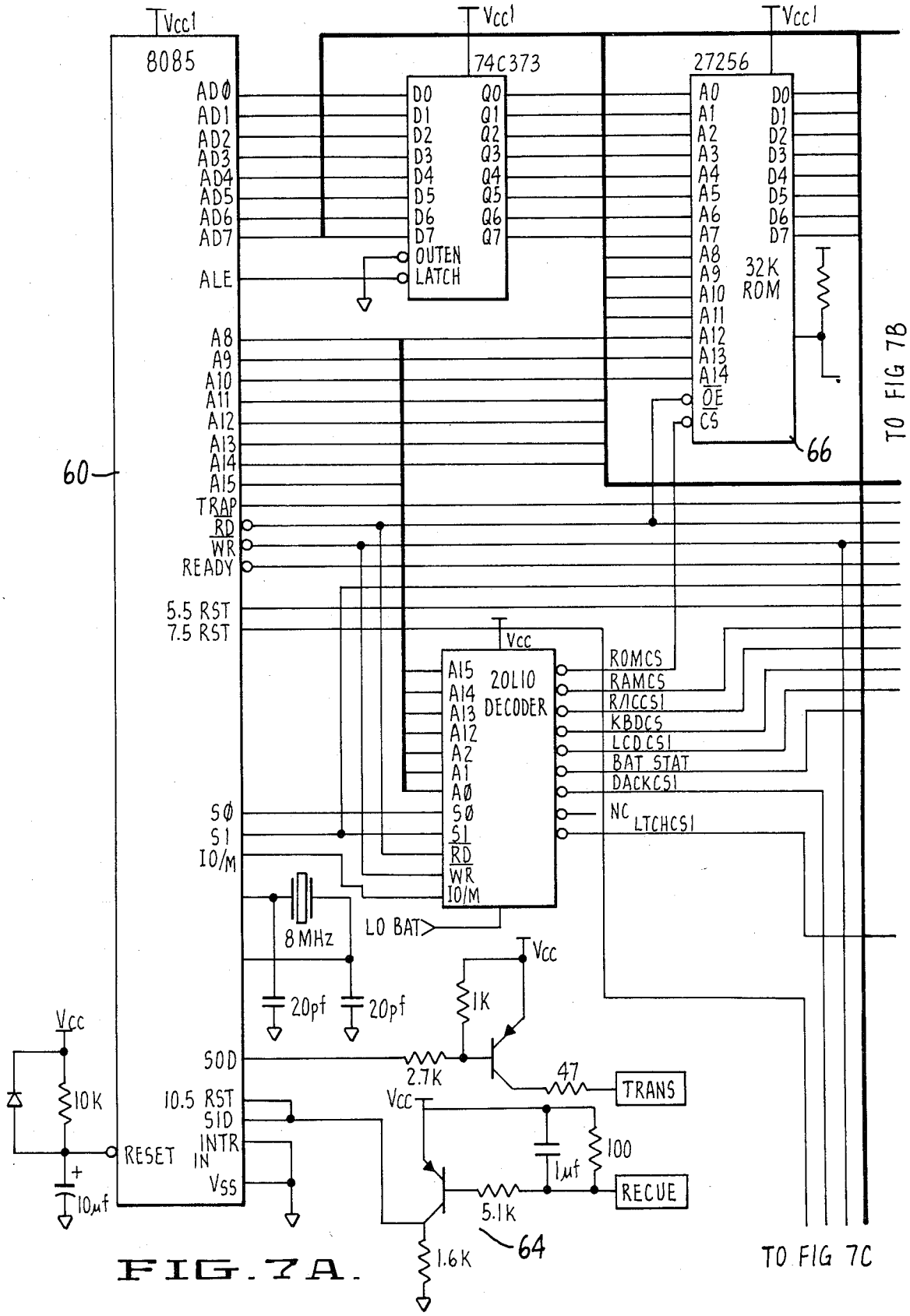
FIGS. 7A–7C are a schematic showing an electrical circuit following the block diagram of FIG. 6.
Figure 7B:
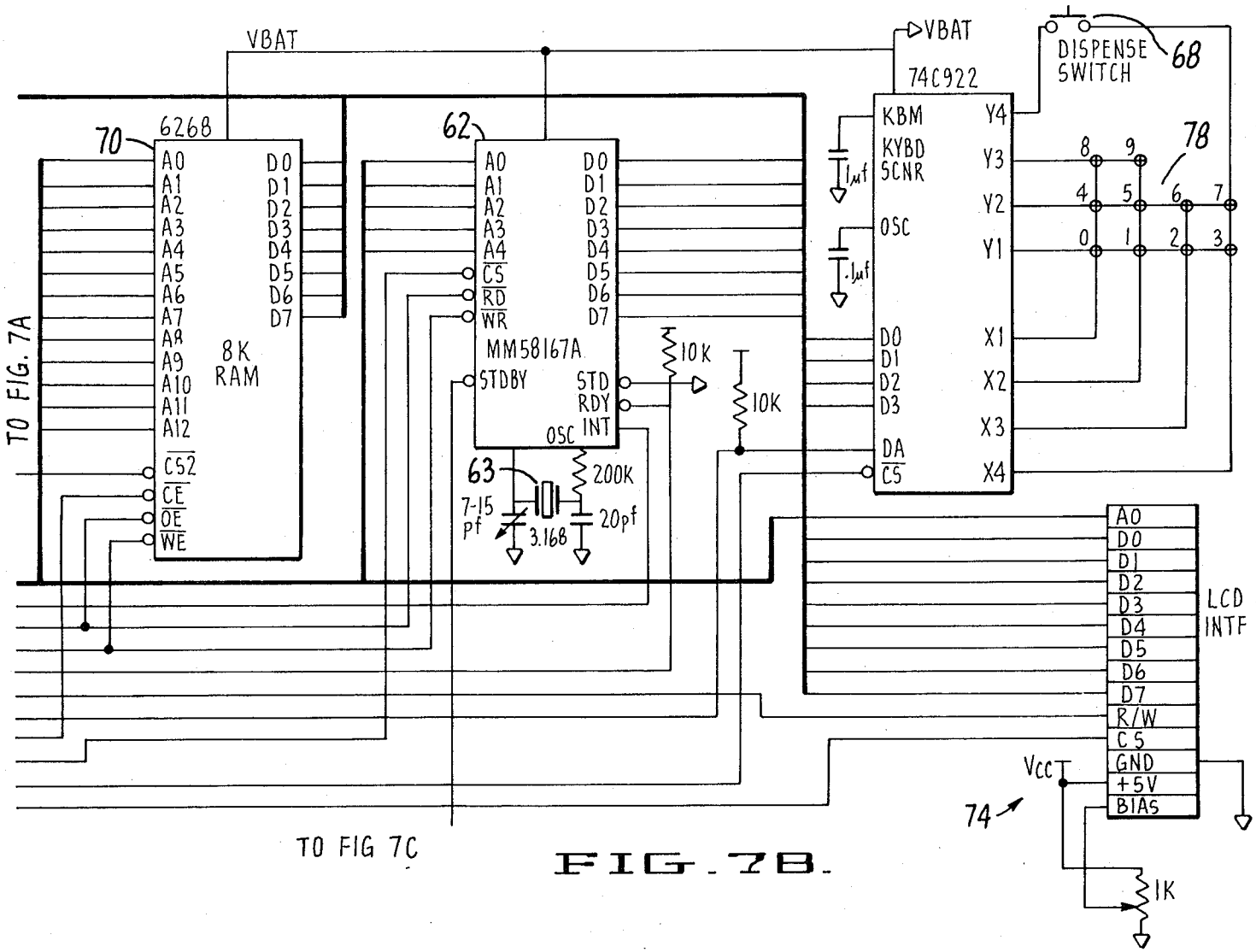
Figure 7C:
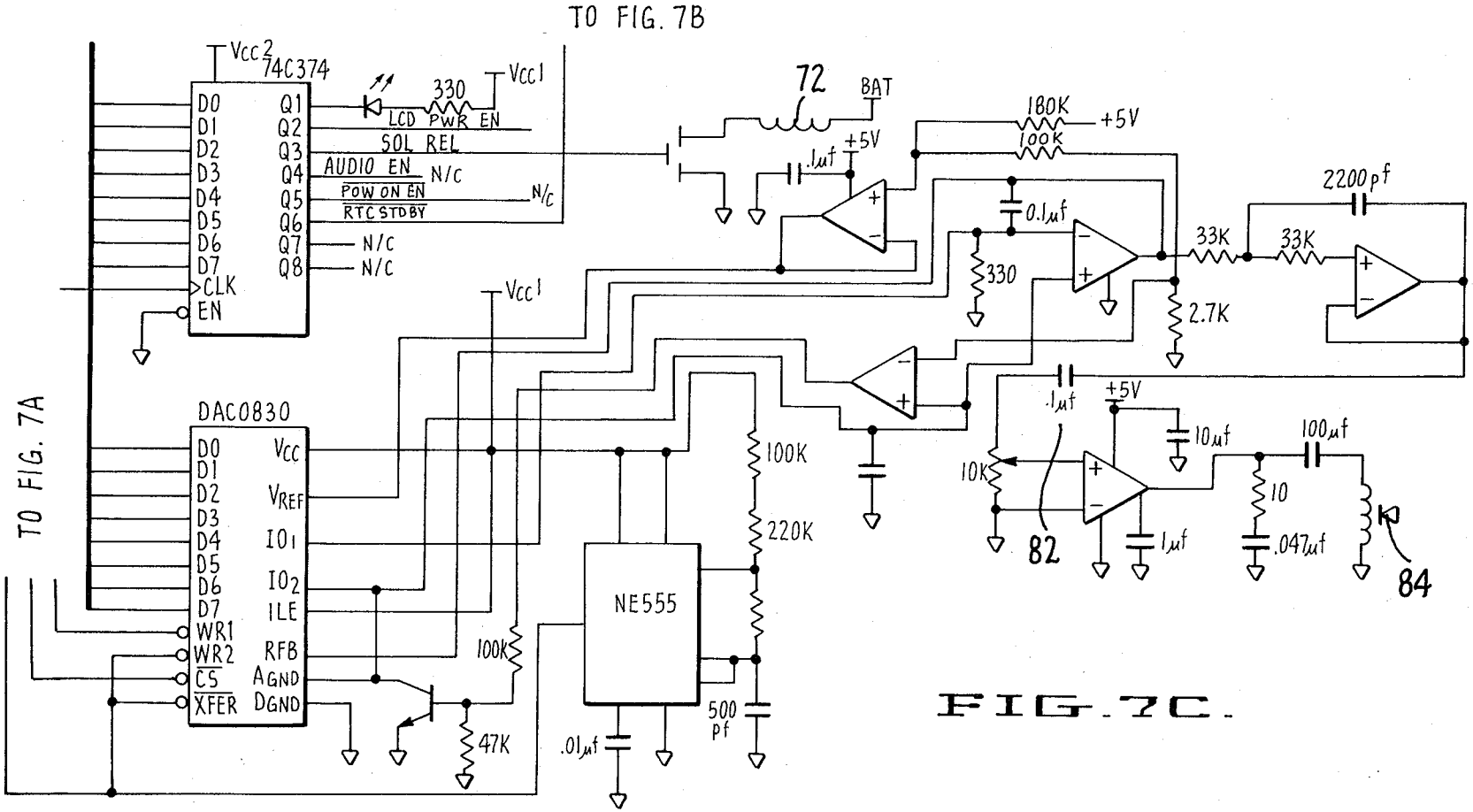

FIG. 7 is a schematic illustrating a circuit embodying the circuitry diagrammed in FIG. 6. The same identifying numbers are used in each of these figures for the same parts. In this schematic, microprocessor 60 is a type 8085 unit. Clock 62 is a MM58167A clock circuit controlled by crystal 63. Data interface 64 includes a data reception port and a data transmission port. These ports operate in RS232 format and the interface includes a circuit to convert these signals into a voltage usable in the microprocessor 60. The program storage 66 is a 32K ROM and the event storage 70 is an 8K RAM. The dose request sensor 68 is an electrical switch. In FIGS. 1–5, this switch is shown as 50. The circuit shown in FIG. 7 has provision for data input from the patient. This is in the form of numeric keyboard 78.

The circuit of FIG. 7 also provides a variety of output signals. These signals include a drug dispensing event. This event is provided by solenoid 72 controlled off of pin Q3 of central status register 80. This register is in turn controlled by microprocessor 60. Solenoid 72 can release the latch 52 as shown in FIG. 4 and thus deliver a dose of drug as described in reference to FIG. 4. Pin Q1 of status register 80 controls a flashing LCD which functions as responding means 76 to signal when a dose should be taken. Pin Q4 of register 80 can control an audible beeper to also signal when a dose is to be taken. Output signals can also take the form of visible alpha-numeric messages displayed on an LCD such as 58 in FIG. 3. This LCD is not directly shown in FIG. 7 but 74 is an interface to which a standard display can be connected. The circuit of FIG. 7 additionally contains audible output stage 82. This stage includes a speaker 84 which can enunciate a variety of audible messages stored in digital form in the device's memory.

The present invention also encompasses an automatic drug dosage compliance method using the contingent dosing device as described above. The method includes recording in a patient-portable memory unit, such as the program storage ROM 66 of FIG. 7, information concerning an initial dosage regimen, the initial regimen comprising times for taking doses in a specified sequence as well as information regarding deviations therefrom. After this recording step, and after the start of the dosing regimen, the device determines when a patient is requesting a dose by noting signals from dose request switch 68, and calculates the actual deviation of the request times from the recorded dose times. The actual deviation is compared in microprocessor 60 to the acceptable deviation set forth in the regimen, and the time difference therebetween is derived. Based on the derived time difference, a dose may or may not be dispensed such as by the action of solenoid 72. The method may include optional steps, i.e. modifying the initial regimen, informing the patient as to the time a dose should be taken (e.g., by audio or visual means or both), and instructing the patient to call his or her health care professional with, optionally, diagnostic information.

The contingent dosing device and method of the present invention thus accommodate a wide variety of contingencies which may arise during a drug administration sequence. The device of this invention will thus can be set up to accommodate situations such as: (1) when a patient seeks to remove more than the scheduled quantity of a drug: (2) when a patient drops or otherwise loses a unit of dispensed medication; (3) circumstances in which it is not possible for the patient to take the dispenser with him or her and so seeks to remove sufficient medication to cover the anticipated interval away from the dispenser: (4) when the patient seeks additional medication for a worsening condition: and/or (5) when the patient seeks lower dosage because of undesirable side effects or an improvement in condition.

While the invention has been described in conjunction with the preferred specific embodiments thereof, the foregoing description as well as the examples which follow are intended to illustrate and not limit the scope of the invention, which is defined by the scope of the appended claims. The following examples illustrate representative dosing regimens and contingencies which may arise during the regimens. They also illustrate how the dosing device of the invention responds to and accommodates these contingencies. Reference will be had in these examples to the flow charts of FIGS. 7–10.

EXAMPLE 1

Figure 9:
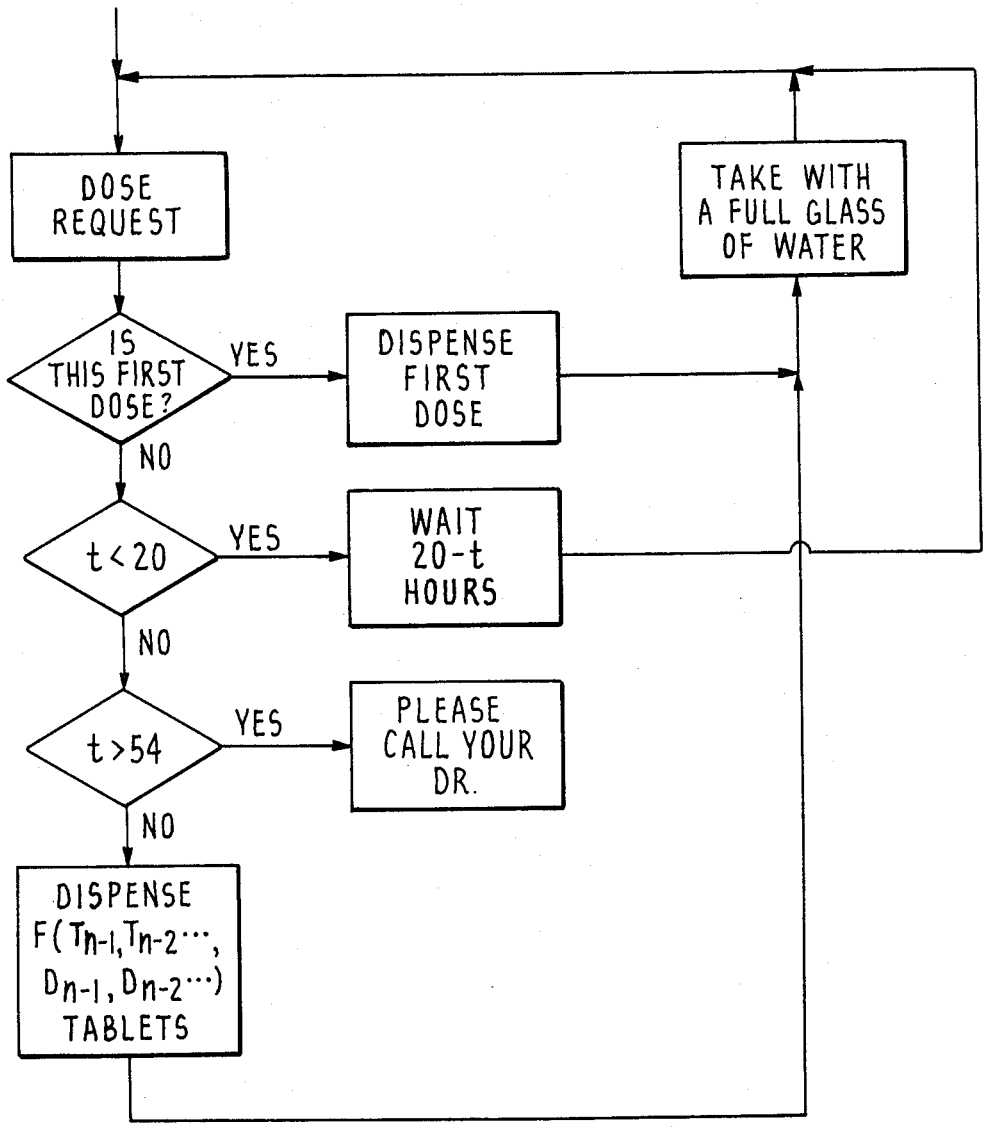

Administration of Digoxin Pursuant to a Mandated Regimen Beginning with a Complex Sequence of Initial Loading Doses A mandated digoxin regimen as accommodated by the device of the present invention is illustrated in the flow chart of FIG. 9. With this drug an initial loading regimen is provided for the first N doses followed by a maintenance regimen for later dosings. To achieve the proper maintenance levels successive doses must be separated by at least 20 hours but by less than 54 hours. In the initial regimen the number of tablets dispensed is a function of N and time (t), $F_I(N,t)$. In the steady state regimen the number of tablets dispensed is F(N,t). After the initial request, the device determines whether the number of the requested dose is less than or equal to N; if this is the case, $F_I(N,t)$ tablets are dispensed, and the device issues a message to the patient to take the dispensed dose with a full glass of water. If the number of the requested dose is greater than N, the device goes on to analyze whether the elapsed time since the previous dose (t) is less than twenty hours. If so, the patient is instructed to wait 20-t hours before taking a dose. If more than 20 hours have passed, but less than 54 hours, F(N,t) tablets are dispensed, and the patient is again instructed to take the dose with water. If more than 54 hours have elapsed since the previous dose, the patient is instructed to call his or her physician, as the actual deviation has exceeded the programmed acceptable deviation.

EXAMPLE 2

Codeine—"As-Needed" Regimen

Figure 8:
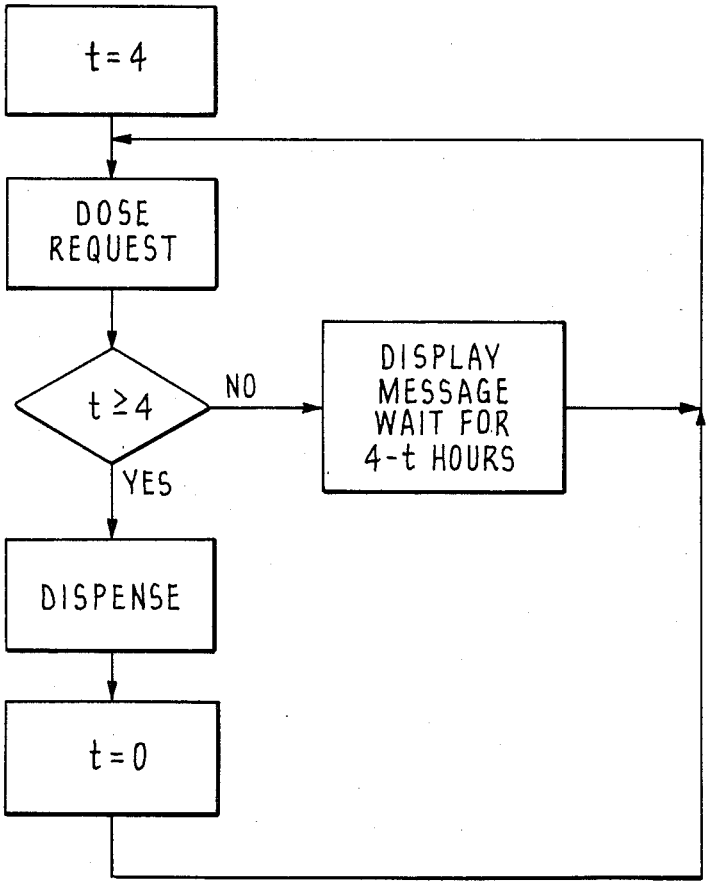
FIGS. 8, 9, 10 and 11 are flow diagrams illustrating examples of dosing regimens as controlled by the contingent dosing device.

Reference is now had to the flow chart of FIG. 8. In the codeine regimen shown there, one pill is to be taken no more often than every four hours as needed for pain. In the flow chart of FIG. 8, "t" is an elapsed time recorded in a register which resets t to 0 each time a dose is dispensed. Initially, t is set to 4 hours (t=4) so that the first dose will automatically be delivered upon demand. Thereafter, when the patient requests a dose, the device determines whether t is greater than or equal to 4. If not, the dose is refused, and the patient is instructed to wait for 4-t hours until taking a dose. If t is greater than or equal to 4, a dose is dispensed and the timer is reset to 0 (t=0).

EXAMPLE 3

Figure 10:
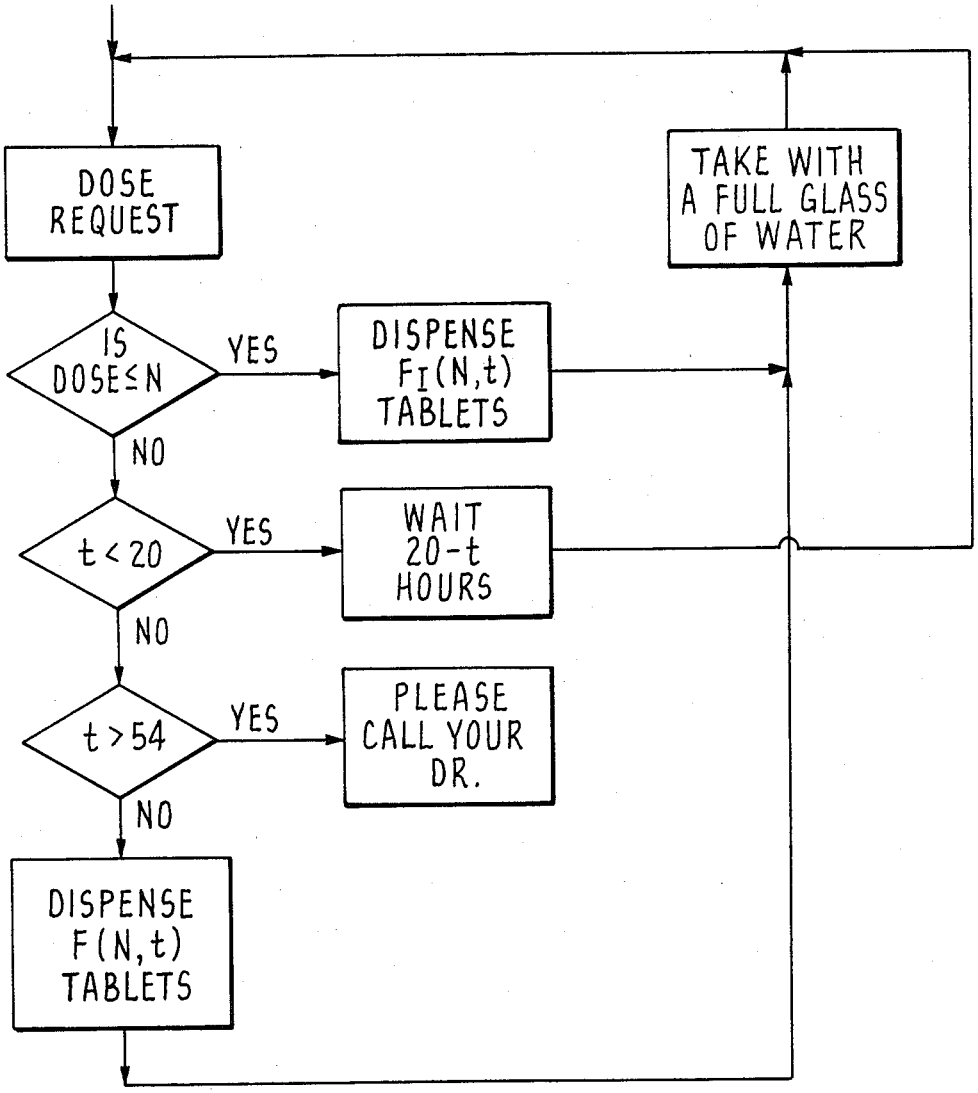

Warfarin—Mandated Regimen with a Long Half-life, Routinely and Frequently Monitored Drug A warfarin, mandated regimen is illustrated in the flow chart of FIG. 10. A preprogrammed first dose is administered followed by dosages determined by a function F which calculates the current dose based on the past n dosing times and amounts. No dose is dispensed if the patient has taken a dose within 20 hours or if more than 54 hours have elapsed since the patient took the last dose. In the latter case, the patient is informed to call his or her doctor. The function F allows the dispensed dose to be increased to compensate for the patient's having gone, e.g. 48 hours without having taken a dose. The function F is subject to fortnightly to monthly revision in light of tests performed at those intervals to determine the magnitude of warfarin's anticoagulant effect in the patient. Such periodic revision is easily programmed into the device of this invention but is confusing for patients to master independently.

EXAMPLE 4

Figure 11:
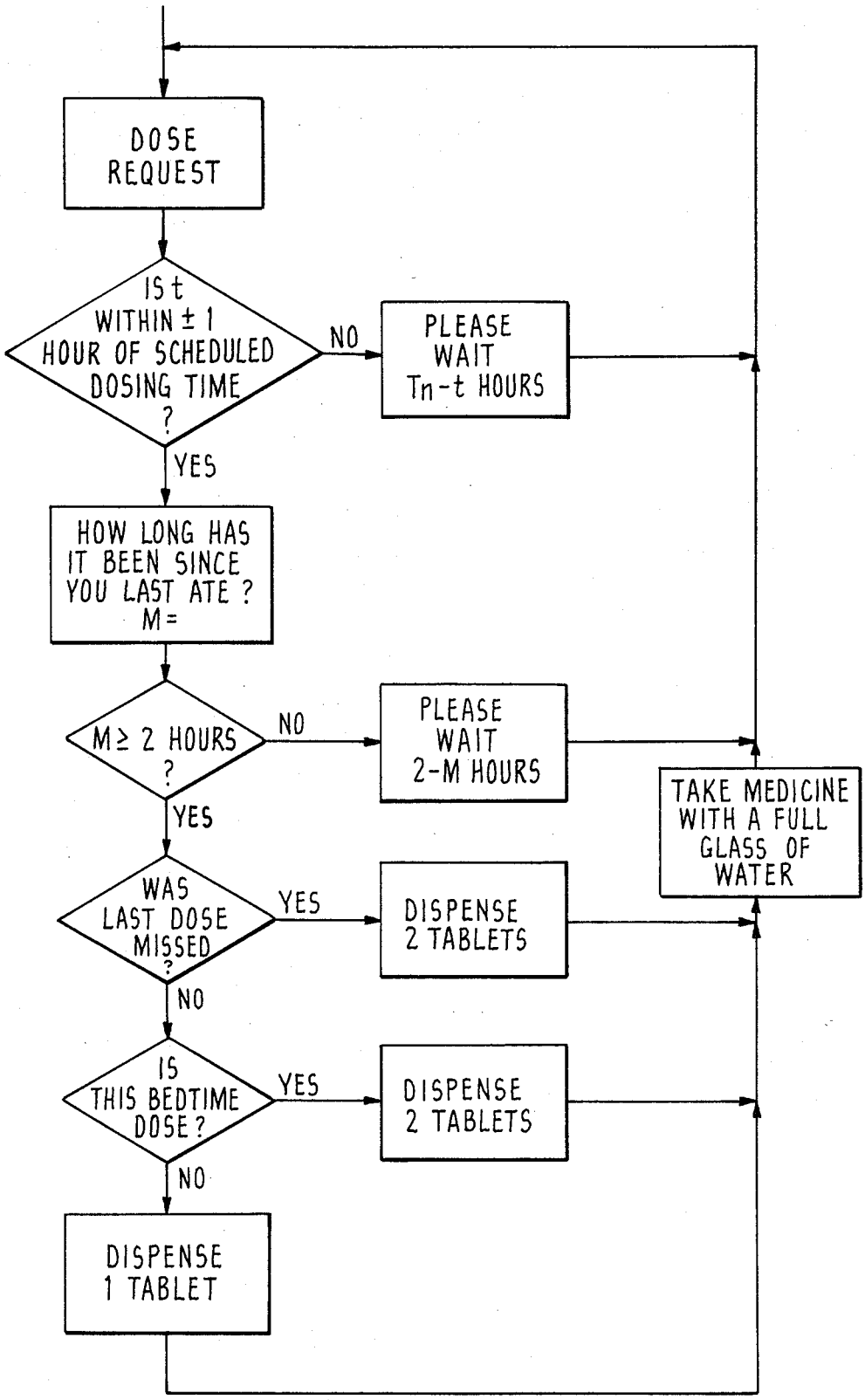

Tetracycline–A Mandated Regimen with a Drug Having a Complex Interaction with Food The flow chart of FIG. 11 illustrates a tetracycline regimen. One capsule is to be taken four times a day. If a patient misses a dose, then two capsules are to be taken at the next dosing time. Two capsules are also to be taken at bedtime in order to compensate for the greater than six hour interval between the bedtime and awakening doses. It will be appreciated that such within-day variations in dose are usually not prescribed in current practice, even though they may be pharmacokinetically preferable, because they tend to confuse patients. In no case should more than two pills ever be taken at one time. The regimen allows for a two hour window around the scheduled dosing time. Tetracycline should only be taken on an empty stomach. Therefore the regimen provides that the device will interrogate the patient as to when he or she last ate. If at least two hours have passed since eating, and the other conditions are met, a dose will be administered. If two hours has not elapsed since eating the dose will be denied and the device instructs the patients to wait at least two hours after eating before taking a dose. When a dose is administered, the patient receives instructions to take the medication with a full glass of water and further instructed to not eat for ½ hour after taking the dose. The device can record whether a dose is a bedtime dose and whether the previous dose was taken or missed.

What is claimed is:

1. A contingent dosing device for controlling the dispensing of a drug to a patient, comprising:

a time counter capable of recording one or more starting times and of measuring at least one elapsed time period from the one or more starting times;

means for recording an initial dispensing regimen, said regimen including information concerning the times for taking doses in a specified sequence and information regarding acceptable deviations therefrom;

means for relating the start of said dispensing regimen to a time recorded or measured by the time counter;

means for determining when the patient requests to take a dose of the drug;

means for calculating the actual deviation of the request from the recorded dosing time of said regimen;

means for comparing the actual deviation with the acceptable deviation set forth in the regimen and deriving the time difference therebetween; and means for informing the patient as to the acceptability of said time difference, whereby if said actual deviation is less than or equal to said acceptable deviation, a dose is dispensed and whereby if said actual deviation is greater than or equal to said acceptable deviation, a dose is refused.

2. The device of claim 1, further including a means for modifying the initial regimen to yield a modified regimen to accommodate the actual deviation.

3. The device of claim 1, further including a means for modifying the initial regimen to yield a modified regimen when the actual deviation is greater than the acceptable deviation.

4. The device of claim 2, wherein the means for determining said actual deviation includes a means for basing this deviation on said modified regimen.

5. The device of claim 1, further including a means for recording the times at which said requests are made.

6. The device of claim 1, additionally comprising a means for controlling the delivery of the dose of the drug to the patient.

7. The device of claim 6, additionally comprising means for recording the times at which a dose is requested.

8. The device of claim 6, additionally comprising a means for recording the times at which a dose is delivered.

9. The device of claim 6, wherein the means for informing the patient includes a means for varying the delivery of the dose of the drug to the patient.

10. The device of claim 6, further including a means for recording the dose that is delivered and the times at which said dose is delivered.

11. The device of claim 10, wherein the means for informing the patient includes visual display means.

12. The device of claim 10, wherein the means for informing the patient includes audible signalling means.

13. The device of claim 1, wherein the means for informing the patient includes a means for instructing the patient.

14. The device of claim 13, wherein the means for instructing the patient includes a means for instructing the patient to contact the patient's health care professional.

15. The device of claim 14 wherein the means for instructing the patient includes a means for instructing the patient to convey diagnostic information to the patient's health care professional.

16. The device of claim 1, additionally comprising a means for informing the patient when to request a dose according to said initial regimen.

17. The device of claim 2, additionally comprising means for informing the patient when to request a dose according to said modified regimen.

18. The device of claim 1, further including a means for interrogating the patient during the dosing regimen.

19. The device of claim 18, further including a means for modifying the regimen based on the results of said interrogation.

20. A contingent dosing device for controlling the dispensing of a drug to a patient, comprising:

a time counter capable of recording one or more starting times and of measuring at least one elapsed time period from the one or more starting times;

means for recording an initial dispensing regimen, said regimen including information concerning the times for taking doses in a specified sequence and information regarding acceptable deviations therefrom;

means for relating the start of said dispensing regimen to a time recorded or measured by the time counter;

means for determining when the patient requests to take a dose of the drug;

means for calculating the actual deviation of said request from the recorded dosing time of said regimen;

means for comparing the actual deviation with the acceptable deviation set forth in the regimen and deriving the time difference therebetween; and means for informing the patient's health care professional as to said time difference.

21. An automatic drug dosage compliance method, comprising the steps of:

(a) recording in a patient-portable memory unit an initial dispensing regimen, said regimen including information concerning the times for taking doses in a specified sequence and information regarding acceptable deviations therefrom;

(b) determining the times when a patient requests to take a dose of a drug;

(c) calculating the actual deviation of the request times from the recorded dosing times;

(d) comparing the actual deviation with the acceptable deviation set forth in the regimen and deriving the time difference therebetween; and (e) automatically informing the patient as to the acceptability of said time difference, whereby if said actual deviation is less than or equal to said acceptable deviation, a dose is dispensed and whereby if said actual deviation is greater than or equal to said acceptable deviation, a dose is refused.

22. The method of claim 21, further including modifying the initial regimen to yield a modified regimen when the actual deviation is greater than the acceptable deviation.

23. The method of claim 21, wherein said calculating of the actual deviation is based on the modified regimen.

24. The method of claim 21, additionally comprising controlling the delivering of the dose of the drug of the patient.

25. The method of claim 24, wherein the informing the patient includes varying the delivering of the dose of the drug to the patient.

26. The method of claim 21, wherein the informing the patient includes visual displaying.

27. The method of claim 21, wherein the informing the patient includes audible signalling.

28. The method of claim 21, wherein the informing the patient includes instructing the patient.

29. The device of claim 21, additionally comprising informing the patient when to request a dose according to said initial regimen.

30. The device of claim 21, further including informing the patient when to request a dose according to said modified regimen.

* * * * *